US005230327A

United States Patent [19]

Jang et al.

[11] Patent Number: 5,230,327

[45] Date of Patent: Jul. 27, 1993

[54] KITCHEN SMOKE EXHAUSTER

[76] Inventors: Sun-Sing Jang, 650, Yuan-Huan E. Rd., Fong-Yuan, Taichung; Ming-Shyan Jang, 162, Sec. 2, Sing-Sing Rd., Tan-dzu, Taichung, both of Taiwan

[21] Appl. No.: 920,739

[22] Filed: Jul. 28, 1992

[51] Int. Cl.[5] ..... F24C 15/20

[52] U.S. Cl. ..... 126/299 R; 126/299 D

[58] Field of Search ..... 126/299 R, 299 D, 300, 126/301, 21 R, 302; 55/DIG. 36

[56] References Cited

U.S. PATENT DOCUMENTS 4,089,328 5/1978 Bergmark ..... 126/299 D
4,090,499 5/1978 Galassi ..... 126/299 D
5,027,790 7/1991 Chern ..... 126/299 D

*Primary Examiner*—James C. Yeung
*Attorney, Agent, or Firm*—Browdy and Neimark

[57] ABSTRACT

A kitchen smoke exhauster comprises a housing, an air flow chamber, two motors, a bottom member, a partition, and a bottom board. The bottom member is provided with the grease exit pipe, the grease guide portion and the bevel groove to facilitate the collection of grease contained in the cooking fume. The bottom member is further furnished with left and right baffling portions preventing the contamination of food by the grease. The air flow chamber is provided with the arcuate right and left flow guides serving to enhance the smoke-removing efficiency of the kitchen smoke exhauster. Both air flow chamber and bottom member can be easily removed from the exhauster for cleaning.

14 Claims, 9 Drawing Sheets

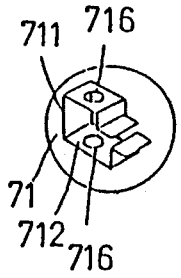
FIG.3A
FIG.3B
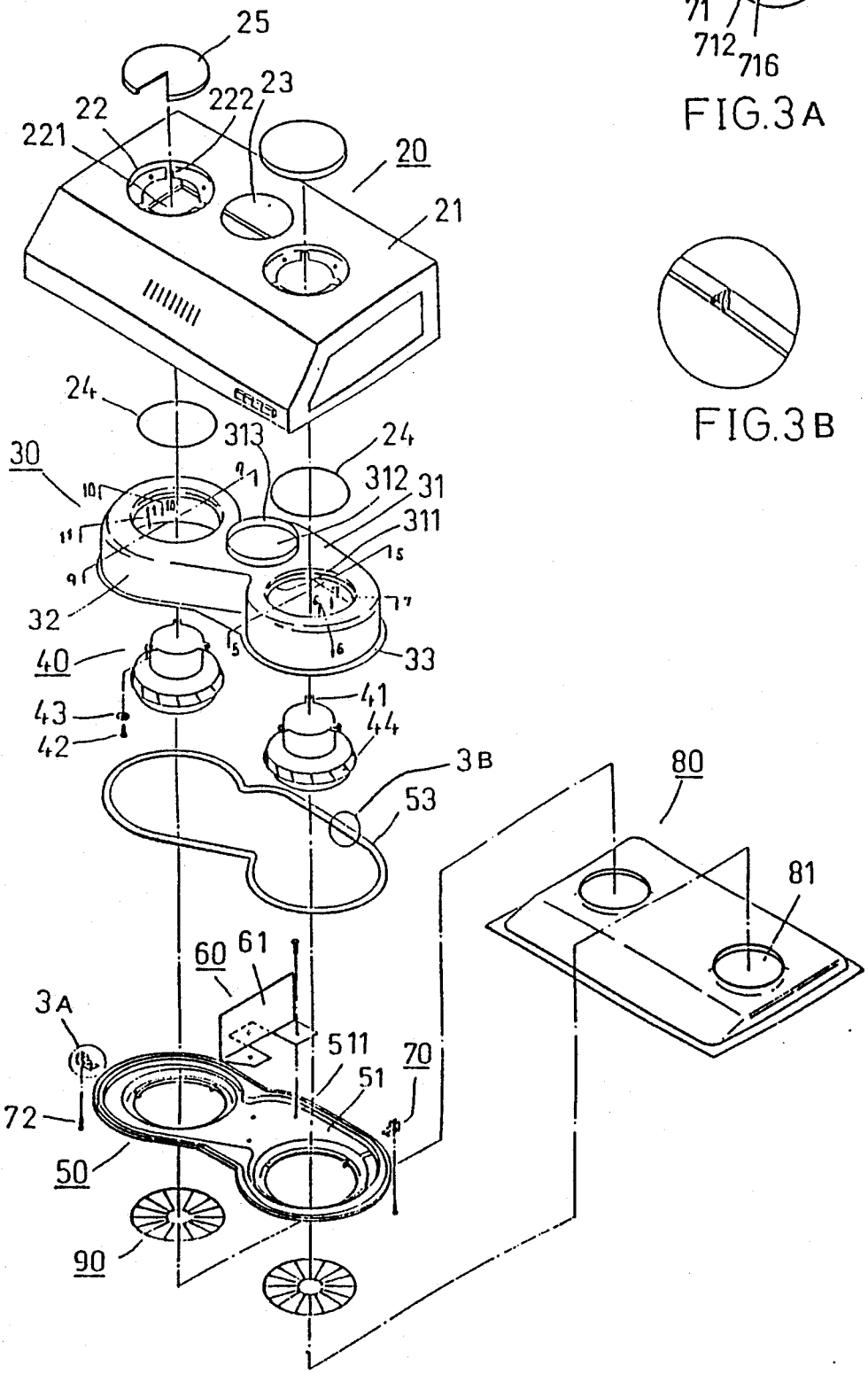
FIG.3

KITCHEN SMOKE EXHAUSTER

BACKGROUND OF THE INVENTION

The present invention relates generally to a kitchen appliance, and more particularly to an exhauster capable of removing the cooking fume from a kitchen.

As shown in FIGS. 1 and 2, a conventional kitchen smoke exhauster 10 of the prior art comprises mainly a housing 11, an air flow chamber 12, two motors 13, two lobed wheels 14, two grease traps 15, and a bottom plate 16. When the kitchen smoke exhauster 10 is turned on, the lobed wheels 14 are driven by the motors 13 to produce a current of air to draw the cooking fume into the air flow chamber 12. The grease steam carried in the cooking fume is subsequently directed by a centrifugal force to move along the direction tangential to the lobe surfaces of the lobed wheels 14, so as to reach an inner wall 121 of the air flow chamber 12, from which the grease steam is further guided to flow downwards to arrive at a bottom wall 122 of the air flow chamber 12, as indicated by an arrow 17 in FIG. 2. The captured grease is finally collected and held in a grease reservoir (not shown in the drawings) via an exit port 152 of a grease channel 151 of the grease trap 15.

The kitchen smoke exhauster 10 of the prior art described above is a time-honored kitchen appliance; nevertheless it has the following defects that need to be addressed and improved:

(a) The efficiency of removing the grease steam carried in the cooking fume is generally unsatisfactory, in view of the facts that the sticky grease has in itself a poor mobility and that the grease steam is carried through a long path before it is finally collected and held in the reservoir. In addition, it is often difficult to clean up the grease that has deposited and accumulated on the bottom wall 122 of the air flow chamber 12.

(b) The crumbled grease crusts are likely to be blown out of the air flow chamber 12 via a smoke entrance 161 of the bottom plate 16 in a direction indicated by a dotted arrow 18 in FIG. 2, thereby resulting in contamination of the food that is being cooked on a cook top located under the kitchen smoke exhauster 10.

(c) The top edge of the air flow chamber 12 meets vertically the underside of the upper plate of the kitchen smoke exhauster 10 to form a junction A as shown in FIG. 2. Such junction is often a culprit responsible for a poor ventilation at such time when the kitchen smoke exhauster 10 is in operation.

SUMMARY OF THE INVENTION

It is, therefore, the primary objective of the present invention to provide a kitchen smoke exhauster with means capable of preventing the crumbled grease crusts, which have deposited inside the kitchen smoke exhauster, from being blown out to contaminate the food that is being cooked on a cook top located under the kitchen smoke exhauster.

It is another objective of the present invention to provide a kitchen smoke exhauster with an air flow chamber which is so designed as to maximize its ventilation effect.

The present invention may best to understood through the following description with reference to the accompanying drawings, in which:

BRIEF DESCRIPTION OF THE DRAWINGS

FIG. 3 shows an exploded view of a kitchen smoke exhauster of the present invention;

FIG. 3A is an enlarged view of Reference No. 3A;

FIG. 3B is an enlarged view of Reference No. 3B;

DETAILED DESCRIPTION OF THE PREFERRED EMBODIMENT

Figure 1:
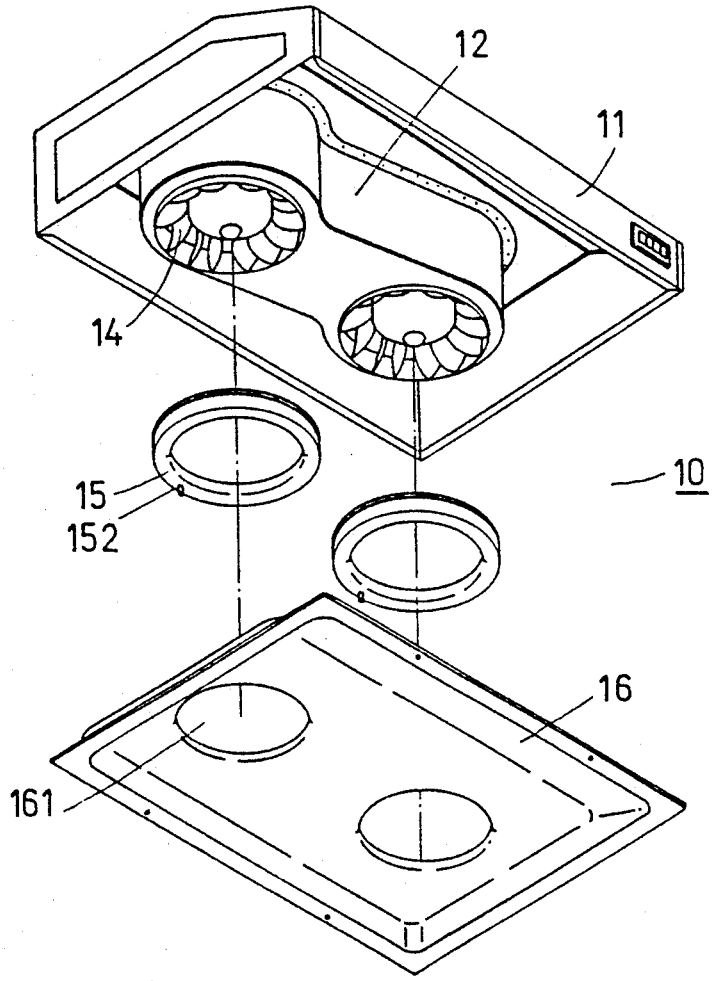
FIG.1 (PRIOR ART)
FIG. 1 shows an exploded view of a kitchen smoke exhauster of the prior art.
Figure 2:
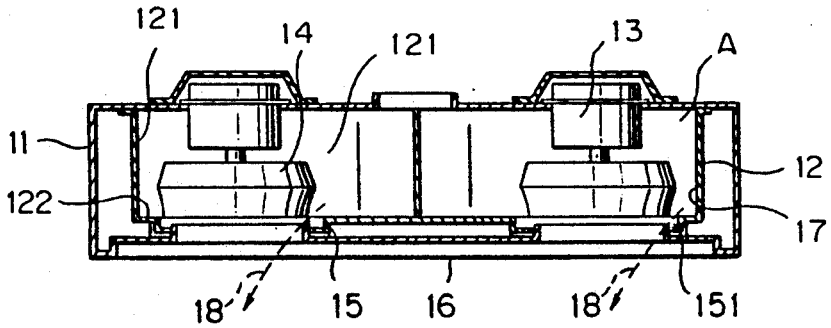
FIG. 2 (PRIOR ART)
FIG. 2 shows a sectional view of the kitchen smoke exhauster in combination of FIG. 1.
Figure 4:
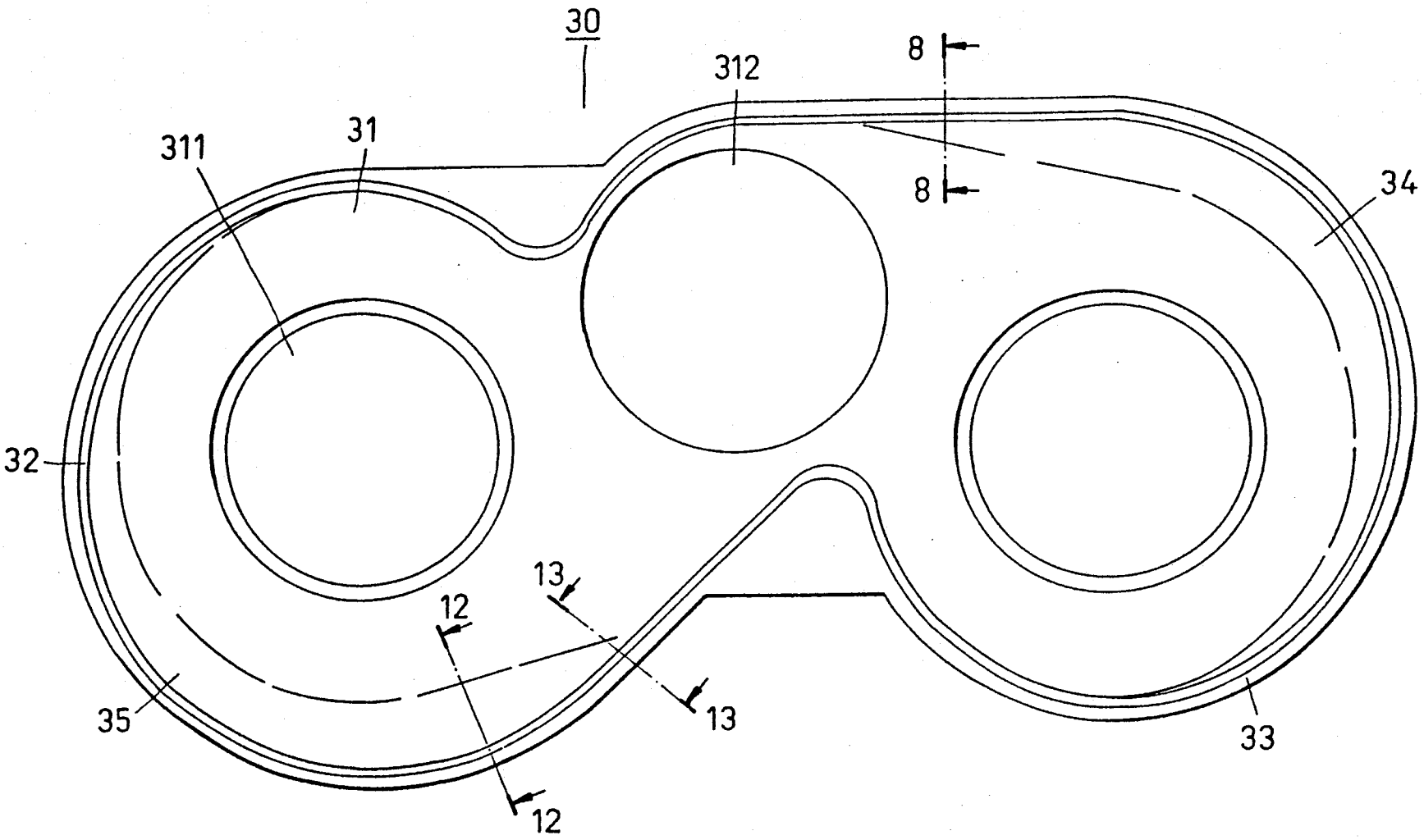
FIG. 4 shows a top view of an air flow chamber 30 of the present invention.
Figure 5:
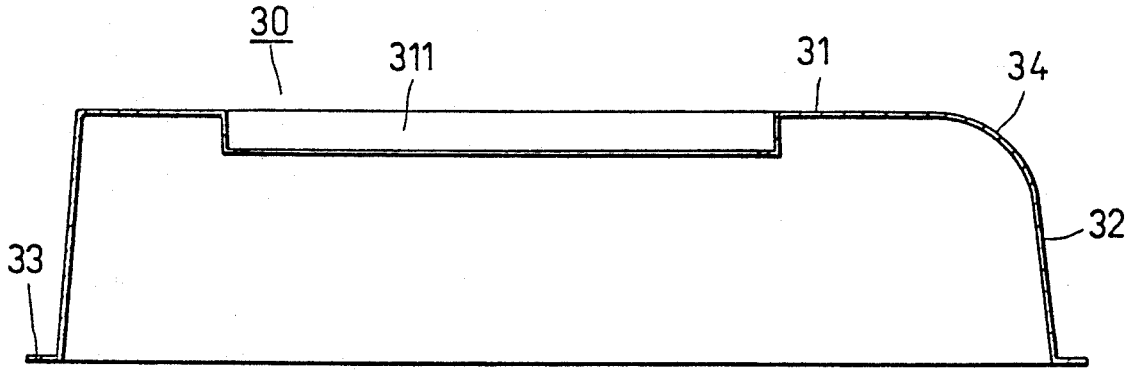
FIG. 5 shows a sectional view of a portion taken along the line 5—5 as shown in FIG. 3.
Figure 6:
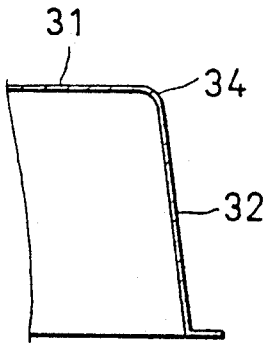
FIG. 6 shows a sectional view of a portion taken along the line 6—6 as shown in FIG. 3.
Figure 7:
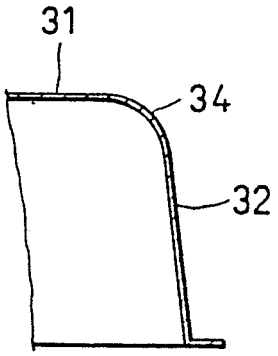
FIG. 7 shows a sectional view of a portion taken along the line 7—7 as shown in FIG. 3.
Figure 8:
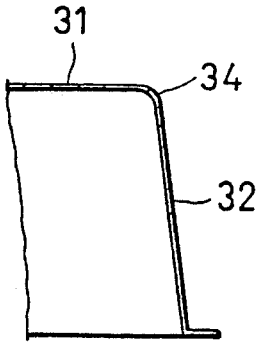
FIG. 8 shows a sectional view of a portion taken along the line 8—8 as shown in FIG. 4.
Figure 9:
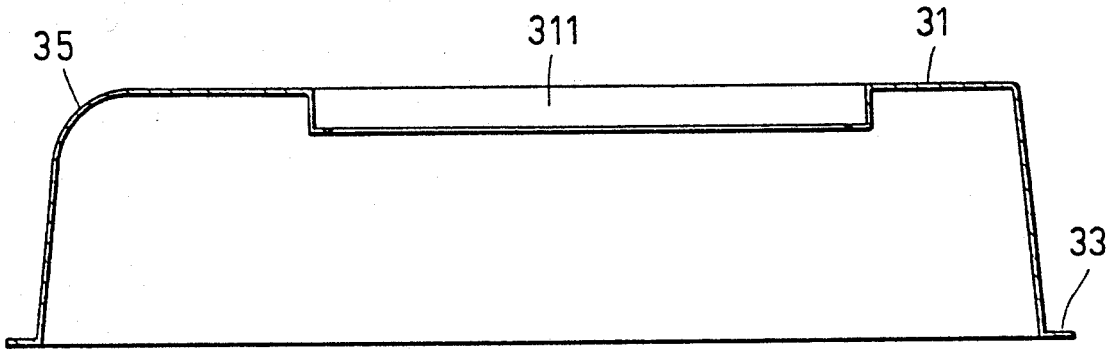
FIG. 9 shows a sectional view of a portion taken along the line 9—9 as shown in FIG. 3.
Figure 10:
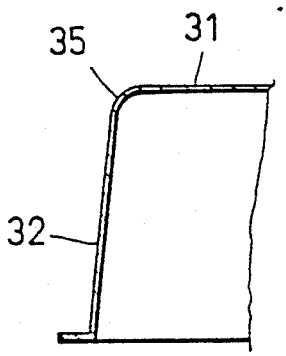
FIG. 10 shows a sectional view of a portion taken along the line 10—10 as shown in FIG. 3.
Figure 11:
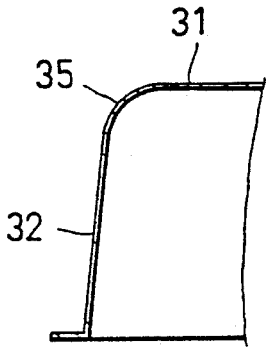
FIG. 11 shows a sectional view of a portion taken along the line 11—11 as shown in FIG. 3.
Figure 12:
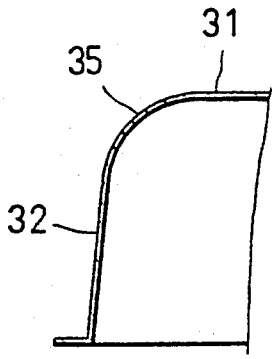
FIG. 12 shows a sectional view of a portion taken along the line 12—12 as shown in FIG. 4.
Figure 13:
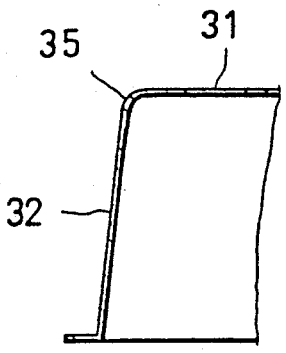
FIG. 13 shows a sectional view of a portion taken along the line 13—13 as shown in FIG. 4.

Referring now to FIGS. 3–22, a preferred embodiment of the present kitchen smoke exhauster include a housing 20, an air flow chamber 30, two motors 40, a bottom member 50, a partition 60, a predetermined number of arresting means 70, a bottom plate 80, and two metal screens 90.

The housing 20 is provided with an upper plate 21 having two receiving seats 22 spaced at a predetermined interval. Each of the two recessed receiving seats 22 is furnished at the bottom wall thereof with a circular through hole 221 and three notches 222. Located between the two receiving seats 22 is a large round hole 23 having a center located behind the line connecting the centers of the two receiving seats 22. In addition, each of the receiving seats is provided with a sealing ring 24 located at the upper segment of the outer circumference thereof, and with a cap 25 located at the upper portion thereof so as to make the top surface of the housing 20 to appear flat and smooth.

The air flow chamber 30 has a top plate portion 31 of a predetermined shape. The edge of the top plate portion 31 extends downwards, outwards and obliquely to form an enclosing portion 32 having a flange 33 extending outwards from the bottom edge thereof. The top plate portion 31 is further provided with two lower receiving seats 311 and a round hole 312, which are arranged at positions corresponding to the housing 20. The upper portion of the round hole 312 is furnished with a ringed portion 313. As shown in FIGS. 3–13, the right half portion of the air flow chamber 30, which is located at the junction between the top plate portion 31 and the enclosing portion 32, extends counter-clockwise (viewing from the top) in such a manner that it becomes progressively larger from the front side thereof toward the rear side thereof, so as to form a right flow guide 34 which in turn extends a predetermined length in such a manner that it becomes progressively smaller from the rear side thereof. On the other hand, the left half portion of the air flow chamber 30 extends counter-clock-wise in such a manner that it becomes progressively larger from a portion located slightly to the left of the rear side of the air flow chamber 30, so as to form a left flow guide 35.

The upper edge of each of the two motors 40 is provided with three lugs 41 extending outwards. The top portion of the air flow chamber 30 is pressed against the bottom portion of the housing 20 so as to permit the lugs 41 of the motor 40 to pass through the lower receiving seat 311 of the air flow chamber 30 and the notches 222 of the housing 20. The motor 40 is rotated slightly to allow the screw 42 to pass through a washer 43 and the through hole of the housing 20, so as to engage the threaded hole of the lug 41. As a result, the motor 40 is fastened securely. The ringed portion 313 of the air flow chamber 30 extends beyond the large round hole 23 of the housing 20 to couple with an exhaust pipe. A lobed fan 44 is mounted on the shaft of the motor 40.

Figure 14:
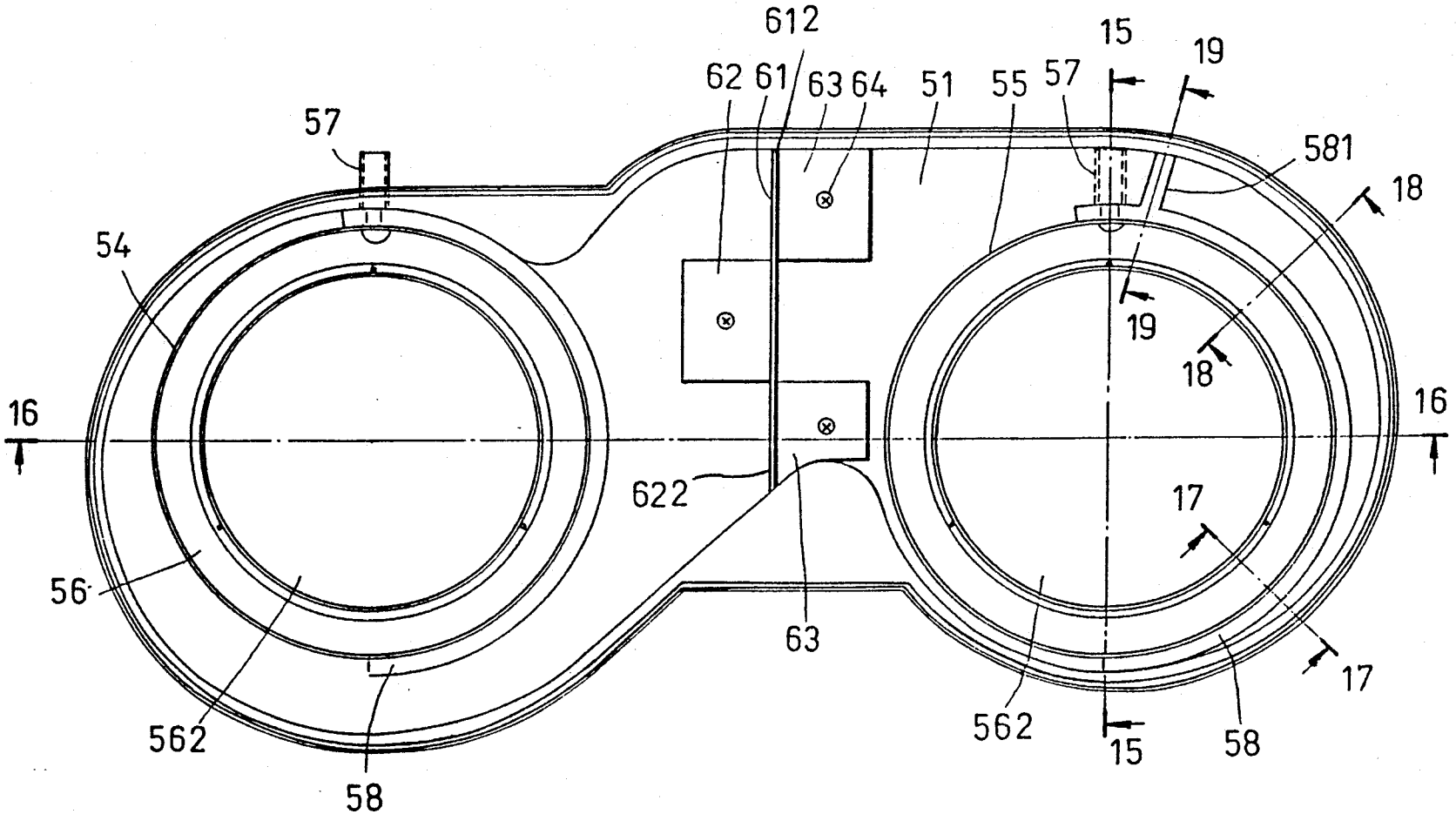
FIG. 14 shows a top view of a bottom member 50 provided with a partition 60.
Figure 17:
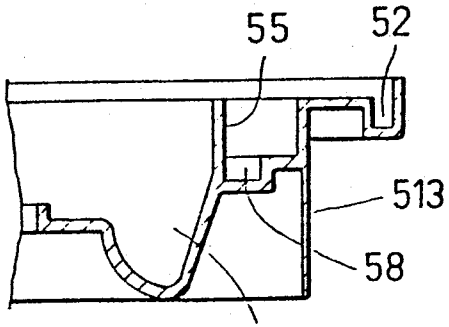
FIG. 17 shows a sectional view of a portion taken along the line 17—17 as shown in FIG. 8.
Figure 15:
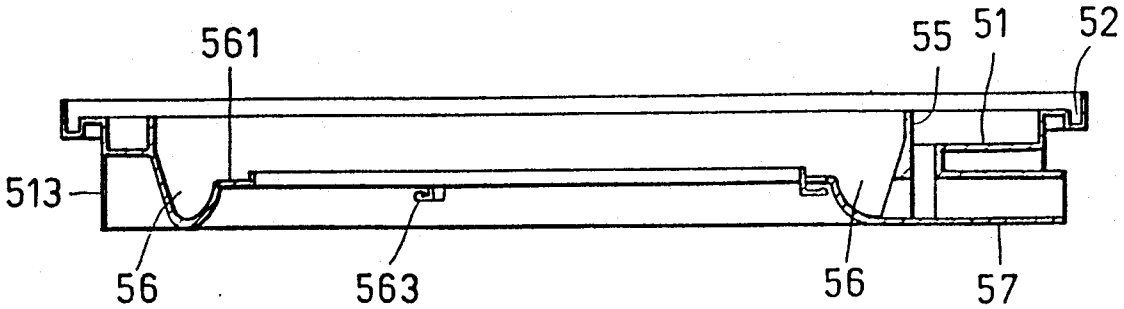
FIG. 15 shows a sectional view of a portion taken along the line 15—15 as shown in FIG. 8.
Figure 16:
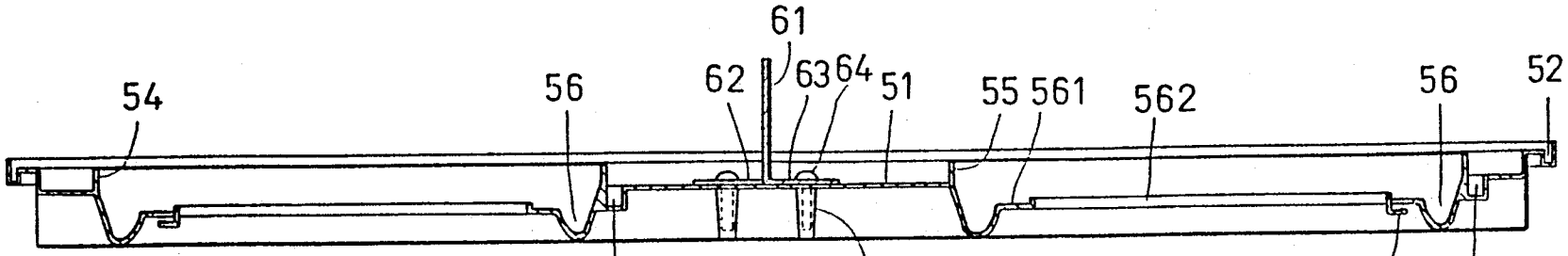
FIG. 16 shows a sectional view of a portion taken along the line 16—16 as shown in FIG. 8.
Figure 19:
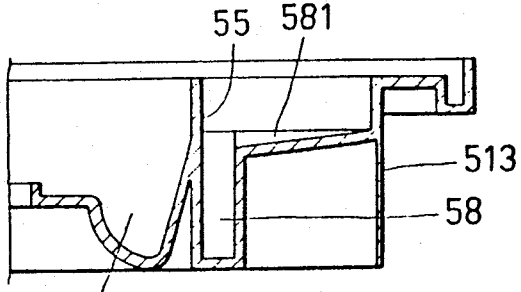
FIG. 19 shows a sectional view of a portion taken along the line 19—19 as shown in FIG. 8.
Figure 18:
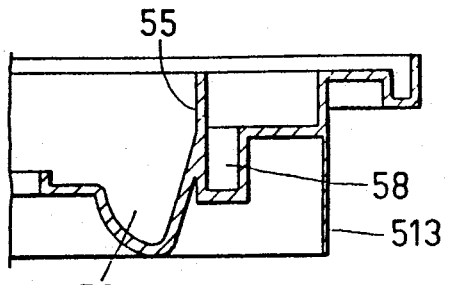
FIG. 18 shows a sectional view of a portion taken along the line 18—18 as shown in FIG. 8.
Figure 20:
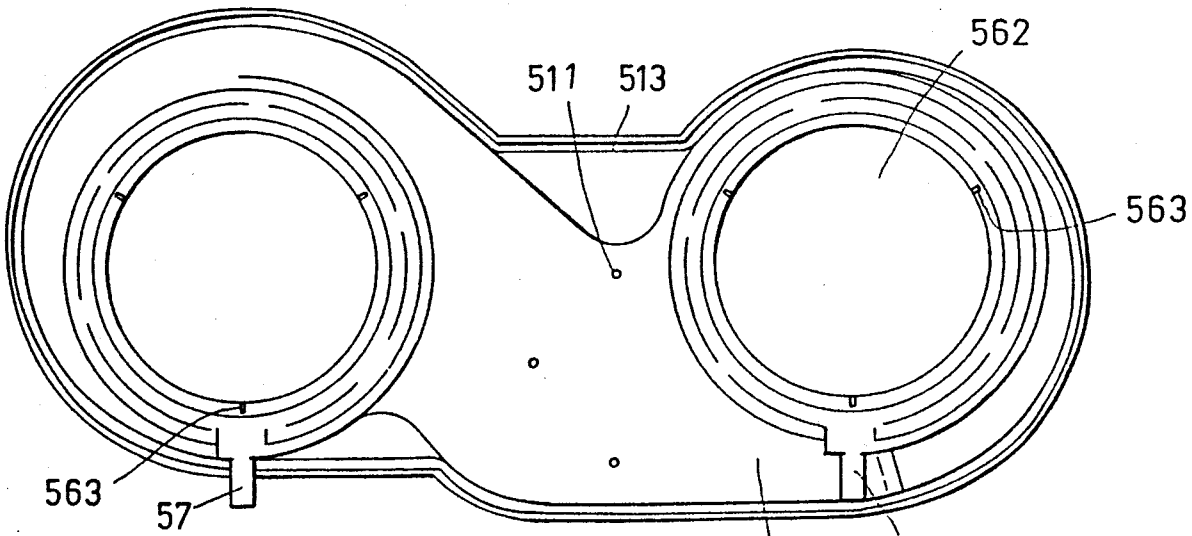
FIG. 20 shows a bottom view of the bottom member.
Figure 21:
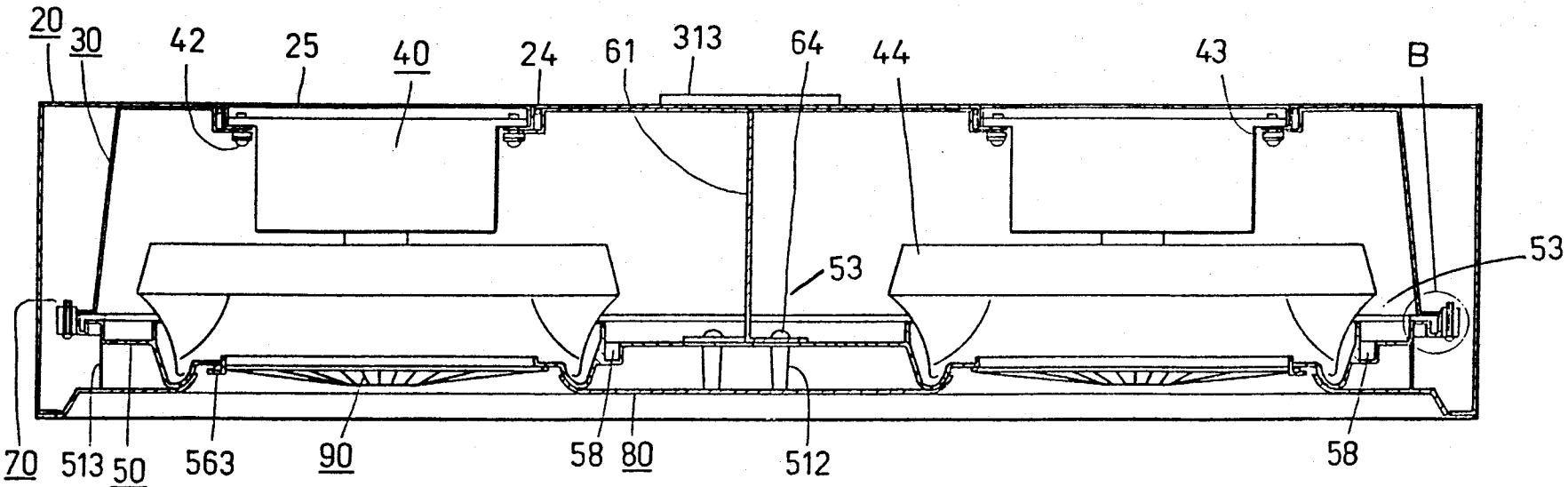
FIG. 21 shows a sectional view of the present invention in combination.

The bottom member 50, which is made of a refractory plastic material by injection molding, has a base portion 51 similar in shape to the top plate portion 31 of the air flow chamber 30. The base portion 51 is provided at outer edge thereof with a receiving slot 52 shown in FIG. 22, which has an upward opening and is intended to receive therein a sealing element 53 having a shape of inverted L in its cross section. As shown in FIG. 14, the base portion 51 has a left baffling portion 54 and a right baffling portion 55, which are located respectively at the left side and the right side thereof and correspondingly to the lower segment of the two lobed fans 44. The left and the right baffling portions 54 and 55 are provided respectively with a groove 56 extending inwards in the inner edge thereof and having a hook profile in its cross section, as shown in FIG. 16. The groove 56 has an inner ringed portion 561 extending inwards in the inner edge thereof to form an air inlet 562. The inner ringed portion 561 is provided equidistantly at the bottom thereof with three L-shaped hook portions 563 shown in FIGS. 16 and 20. The groove 56 is further provided at rear end thereof with a grease exit pipe 57 shown in FIG. 20. A grease guide portion 58 communicating with the grease exit pipe 57 is constructed respectively on the peripheries of the left and the right baffling portions 54 and 55 in such a way that it becomes deeper progressively and counter-clock wise (viewing from the top) from the front sides of the left and the right baffling portions 54 and 55 as shown in FIGS. 18 and 19. A bevel groove 581 in communication with the grease guide portion 58 is arranged at the right rear side of the right baffling portion 55 in such a manner that it becomes deeper progressively from its rear end toward its front end, as shown in FIG. 19. As shown in FIG. 3, the base portion 51 is additionally provided with three threaded holes 511 located at the center of the topside thereof. As shown in FIG. 21, the bottom member 50 is provided at the underside thereof with rib 513 and three propping pins 512 of a predetermined height.

As shown in FIGS. 14 and 16, the partition 60 has an upright plate 61, which comprises a first flat plate 62 and a second flat plate 63. The first flat plate 62 extends leftwards from the bottom edge of the upright plate 61 while the second flat plate 63 extends rightwards respectively from the front and the rear sides of the upright plate 61. The partition 60 is fastened securely in place by means of the first and the second flat plates 62 and 63, which are in turn fastened respectively by a fastening element 64 passing through the threaded hole 511.

Figure 22:
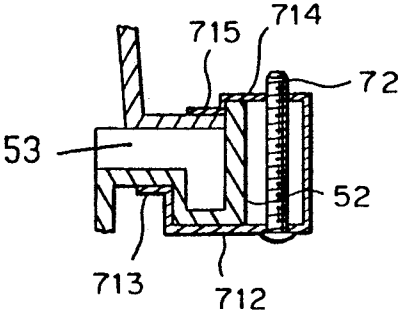
FIG. 22 shows an enlarged view of a portion designated as A in FIG. 21.

As shown in FIGS. 3 and 22, the arresting means 70 comprises a clamping member 71 and an adjusting member 72. The clamping member 71 has a vertical portion 711 provided with a lower horizontal portion 712, which extends inwards from the bottom edge of the vertical portion 711 and has a lower retaining portion 713 extending upwards from the outer side of the lower horizontal portion 712. The clamping member 71 has an upper horizontal portion 714 extending inwards from the upper edge thereof. The upper horizontal portion 714 is provided with an upper retaining portion 715 extending downwards from the outer side thereof. The upper and the lower horizontal portions 714 and 712 are provided correspondingly with threaded holes 716. The upper surface of the sealing element 53 of the bottom member 50 is placed against the bottom surface of the flange 33 of the air flow chamber 30. The lower retaining portion 713 of the clamping member 71 is held in the outer side of the inner end of the receiving slot 52 of the bottom member 50, while the upper retaining portion 715 urges the top surface of the flange 33 of the air flow chamber 30. The upper and the lower horizontal portions 714 and 712 can be kept closer by rotating the adjusting member 72 upwards to pass through the threaded holes 716. As a result, as shown in FIG. 21, the bottom member 50 is retained securely under the air flow chamber 30. In the meantime, the front edge and the rear edge of the partition 60 are respectively on contact with the front and the rear surfaces of the air flow chamber 30, so as to divide the interior of the air flow chamber 30 into two independent cavities. The protruded portion 63 of the partition 60 extends beyond the large round hole 23 of the housing 20.

The bottom plate 80 is fastened to the bottom portion of the housing 20 and is furnished with a smoke entrance 81 located correspondingly to the air inlet 562 of the bottom member 50, as shown in FIG. 21. The strength and the stability of the bottom member 50 are further enhanced by the three propping pins 512 and rib 513, which support the top surface of the bottom plate 80.

The two metal screens 90 are respectively retained by the hook portions 563 of the bottom member 50 at the positions located under the air inlets 562.

The cooking fume containing the grease is directed to the grease exit pipe 57 via the grease guide portion 58 and the bevel groove 581 of the bottom member 50, before the grease is collected and held in the grease reservoir. The groove 56 is used to collect the grease drops that drip from the stationary lobed fan 44. The grease can not be accidentally blown out of the air flow chamber 30 to contaminate the food that is being cooked thereunder, in view of the fact that the bottom member 50 is provided with the left and the right baffling portions 54 and 55, which serve to prevent such incident of food contamination from taking place.

In addition, the smoke-removing efficiency of the kitchen smoke exhauster of the present invention is further enhanced by the arcuate right and left flow guides 34 and 35 of the air flow chamber 30, which serve to eliminate the blind spot and the turbulent air current during the operation of the kitchen smoke exhauster.

Another important feature of the present invention is that both air flow chamber 30 and the bottom member 50 can be easily removed from the exhauster for cleaning. Such removal of the air flow chamber 30 and the bottom member 50 can be done by loosening the adjusting member 72 of the arresting member 70 to allow the upper and the lower horizontal portions 714 and 712 to be opened up, so as to release the bottom member 50.

While the invention has been described in connection with what is presently considered to be the most practical and-preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What is claimed is:

1. A kitchen smoke exhauster comprising:

a housing (20) having a top board, a bottom board, a left side plate and a right side plate, with said top board having at least a large round hole;

an air flow chamber (30) having a top plate portion (31) with an enclosing portion 32 extending downwards from an edge of said top plate portion, said top plate portion engaged to an underside of said top board of said housing, said top plate portion having a round hole located at a position corresponding to that of said large round hole of said housing, said top plate portion having a round hole located at a position corresponding to that of said large round hole of said housing, said enclosing portion provided with a flange (33) extending outwards from a bottom edge thereof;

two motors (40) each having a tip portion fastened to said housing and said air flow chamber each of said two motors having a shaft with a lobed fan mounted thereon;

a bottom member (50) detachably mounted to a bottom of said air flow chamber and provided with a base portion having a profile corresponding to that of said top plate portion of said air flow chamber, said base portion (51) having an outer edge sealably and detachably joined to an underside of said flange of said air flow chamber, said base portion (51) further having a left baffling portion (54) and a right baffling portion (55), each of which is provided with a groove extending inwards from an inner edge thereof and having a hook-shaped profile in its cross section to form an air inlet, a grease exit pipe mounted on said base portion behind said groove, a grease guide portion extending from a periphery of each of said left baffling portion and said right baffling portion so as to become progressively deeper from a starting point on said periphery until said grease guide portion connects with said grease exit pipe;

a partition (60) engaged at the center of a top surface of said bottom member so as to divide an interior of said air flow chamber into two independent air cavities; and said bottom board (80) engaged to a bottom of said housing and having a plurality of smoke entrances.

2. A kitchen smoke exhauster according to claim 1 wherein said bottom member (50) is made from a refractory plastic material by injection molding.

3. A kitchen smoke exhauster according to claim 2 wherein said right baffling portion (55) of said bottom member (50) is provided at a right rear side thereof with a bevel groove, which becomes progressively deeper toward a front end and is in communication with said grease guide portion.

4. A kitchen smoke exhauster according to claim 3 wherein said air flow chamber (30) is provided with an arcuate right flow guide (34) extending counter-clockwise (viewing from the top) in such a manner that it becomes progressively larger from a front end of a junction between said top plate portion (31) and said enclosing portion (32) toward a rear end of a right half portion of said air flow chamber, said right flow guide becoming larger until it reaches said rear end before extending again for a length in such a way that it becomes progressively and arcuately smaller, wherein said air flow chamber is further provided with an arcuate left flow guide (35) extending counter-clock-wise (viewing from the top) in such a manner that it becomes progressively larger from a rear end located slightly to a left of a left half portion of said air flow chamber toward a front end of said left half portion.

5. A kitchen smoke exhauster according to claim 4 wherein said base portion (51) of said bottom member (50) is provided at its periphery with a receiving slot (52), which has an opening facing upwards and is intended to accommodate therein a sealing element (53) having a top surface coming into contact with an underside of said flange of said air flow chamber.

6. A kitchen smoke exhauster according to claim 5 wherein said sealing element (53) is of an inverted L shape in its cross section.

7. A kitchen smoke exhauster according to claim 6 wherein said air flow chamber (30) and said bottom member (50) are held by an appropriate number of arresting means (70) disposed at intervals on edges of said air flow chamber and said bottom member.

8. A kitchen smoke exhauster according to claim 7 wherein said arresting means (70) comprises a clamping member (71) and an adjusting member (72), said clamping member having a vertical portion with its bottom edge extending inwards to form a lower horizontal portion having a lower retaining portion extending upwards from outer side thereof, said clamping member (71) further having an upper horizontal portion extending inwards from upper edge thereof, said lower horizontal portion having an upper retaining portion extending downwards from outer end thereof, said upper horizontal portion and said lower horizontal portion having corresponding threaded holes; wherein said sealing element (53) has a top surface coming into contact with an underside of said flange (33) of said air flow chamber, with said lower retaining portion of said clamping member held in said receiving slot (52) of said bottom member (50), and with said upper retaining portion urging the top surface of said flange (33) of said air flow chamber; and wherein said adjusting member (72) rotates upwards to pass through said threaded holes so as to bring said upper horizontal portion and said lower horizontal portion closer in order to retain said bottom member securely in place under said air flow chamber.

9. A kitchen smoke exhauster according to claim 8 wherein said bottom member (50) is provided at underside thereof with a rib (513) and a plurality of propping pins (512) of a predetermined height, a strength and stability of said bottom member being further enhanced by said rib and said propping pins which support a top surface of said bottom plate.

10. A kitchen smoke exhauster according to claim 9 wherein said bottom member has an inner ringed portion with at least three L-shaped hook portions disposed at intervals on a bottom surface thereof for accommodating a metal screen.

11. A kitchen smoke exhauster according to claim 3 wherein said base portion (51) of said bottom member (50) is provided at a periphery with a receiving slot (52), which has an opening facing upwards and is intended to accommodate therein a sealing element (53) having a top surface coming into contact with an underside of said flange (33) of said air flow chamber.

12. A kitchen smoke exhauster according to claim 11 wherein said sealing element (53) is of an inverted L shape in its cross section.

13. A kitchen smoke exhauster according to claim 12 wherein said air flow chamber and said bottom member are held by a plurality of arresting means disposed at intervals on edges of said air flow chamber and said bottom member.

14. A kitchen smoke exhauster according to claim 13 wherein said arresting means comprises a clamping member and an adjusting member, said clamping member having a vertical portion with a bottom edge extending inwards to form a lower horizontal portion having a lower retaining portion extending upwards from an outer side thereof, said clamping member further having an upper horizontal portion extending inwards from an upper edge thereof, said lower horizontal portion having an upper retaining portion extending downwards from an outer end thereof, said upper horizontal portion and said lower horizontal portion having corresponding threaded holes; wherein said sealing element has a top surface engaged to an underside of said flange of said air flow chamber, said lower retaining portion of said clamping member held in said receiving slot of said bottom member, and said upper retaining portion urging a top surface of said flange of said air flow chamber; and wherein said adjusting member rotates upwards to pass through said threaded holes so as to bring said upper horizontal portion and said lower horizontal portion closer in order to retain said bottom member securely in place under said air flow chamber.

* * * * *